US007687120B2

(12) United States Patent
Niu et al.

(10) Patent No.: US 7,687,120 B2
(45) Date of Patent: Mar. 30, 2010

(54) PRINT MEDIA AND METHODS FOR MAKING THE SAME

(75) Inventors: Bor-Jiunn Niu, San Diego, CA (US); Stefan Schuttel, Murten (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 807 days.

(21) Appl. No.: 10/971,304

(22) Filed: Oct. 21, 2004

(65) Prior Publication Data

US 2006/0088673 A1 Apr. 27, 2006

(51) Int. Cl.
*B41M 5/50* (2006.01)

(52) U.S. Cl. ..... 428/32.24

(58) Field of Classification Search ..... None
See application file for complete search history.

(56) References Cited

U.S. PATENT DOCUMENTS

| | | | | |
|---|---|---|---|---|
| 5,429,860 | A | 7/1995 | Held et al. | |
| 5,877,796 | A * | 3/1999 | Tsuchiya et al. | 347/105 |
| 6,057,026 | A | 5/2000 | Tsuchiya et al. | |
| 6,066,387 | A * | 5/2000 | Ueda et al. | 428/32.27 |
| 6,165,593 | A | 12/2000 | Brault et al. | |
| 6,423,375 | B1 | 7/2002 | Bi et al. | |
| 6,432,523 | B1 | 8/2002 | Ma et al. | |
| 6,528,148 | B2 | 3/2003 | Niu et al. | |
| 6,632,485 | B1 | 10/2003 | Tang et al. | |
| 6,649,232 | B2 | 11/2003 | Ito et al. | |
| 6,689,433 | B2 | 2/2004 | Niu et al. | |
| 6,821,584 | B2 * | 11/2004 | Tashiro et al. | 428/32.24 |
| 2002/0004121 | A1 | 1/2002 | Branham et al. | |
| 2002/0022116 | A1 | 2/2002 | Iu et al. | |
| 2002/0182376 | A1 | 12/2002 | Mukherjee et al. | |
| 2003/0207052 | A1 | 11/2003 | Niu et al. | |
| 2003/0228428 | A1 | 12/2003 | Kim et al. | |

FOREIGN PATENT DOCUMENTS

EP 0 742 109 A 11/1996

OTHER PUBLICATIONS

DuPont Zonyl Fluoroadditives, Technical Information. E.I. du Pont de Nemours and Company, Oct. 2003, 2 pages.
DuPont Zonyl FSA Fluorosurfactant, E.I. du Pont de Nemours and Company, Aug. 2002, 2 pages.
DuPont Zonyl FSN Fluorosurfactant, E.I. du Pont de Nemours and Company, Aug. 2002, 2 pages.
DuPont Zonyl FS-62 Fluorosurfactant, E.I. du Pont de Nemours and Company, Aug. 2002, 2 pages.
DuPont Zonyl UR Fluorosurfactant, E.I. du Pont de Nemours and Company, Aug. 2002, 2 pages.
Daikin, Fluorosurfactant, Unidyne NS-1102, no date, 3 pages.
Printer Guide, Middle East 2003, Issue 1, CPI/Corporate Publishing International, http://www.cpilive.net/news_ver2/guides_2003/printer_guide_issue_01/Buyer_s_Guide.htm, 6 pages.

* cited by examiner

*Primary Examiner*—Bruce H Hess

(57) ABSTRACT

Print media which includes at least one ink-receiving layer comprising at least one anionic fluorosurfactant and may be positioned over the substrate and/or be supported by the substrate.

14 Claims, 3 Drawing Sheets

PRINT MEDIA AND METHODS FOR MAKING THE SAME

FIELD OF THE INVENTION

The present invention relates to media for receiving printed images thereon. More specifically, the present invention relates to media including a substrate and at least one ink-receiving layer over the substrate, the ink-receiving layer comprising at least one anionic fluorosurfactant.

BACKGROUND OF THE INVENTION

In order to effectively generate printed images using various ink transfer techniques and systems known to those of ordinary skill in the art (e.g., thermal inkjet technology), ink-receiving print media having particular characteristics must be employed. Ideally, to achieve maximum efficiency, print media should be able to provide a number of benefits and advantages including, without limitation, a high level of light-fastness, a high level of smear-fastness, and the ability to quickly and completely absorb ink materials in a manner which minimizes or avoids image distortion. As used herein, the terms "light-fast", "light-fastness", and the like refer to the capacity of a print media to retain images thereon in a stable manner without substantial fading, blurring, distortion, and the like over time in the presence of natural or man-made light. The terms "smear-fast", "smear-fastness", and the like, as used herein, refer to the production of images that exhibit minimal to no smearing or blurring when rubbed or otherwise physically engaged with a variety of objects.

Of particular concern are so-called "pick-up tire" markings and pressure markings. "Pick-up tire markings" may occur when, for example, a surface contaminant is transferred from a component of the printing apparatus (e.g., a roller used to pick up the print media and transport in through the printer) to the print media. Pressure markings (sometimes referred to as "fingerprinting") may occur due to pressure applied to the printed image by the print operator's hands, fingers, and the like. Pick-up tire markings and pressure markings may generate printed images wherein the dot size in the contaminated or marked regions of the print media is overspread or increased relative to the dot size in the uncontaminated or unmarked regions. This causes the printed images to appear smeared or blurred.

It is known in the art to apply coating formulations to one or more ink-receiving surfaces of a print media in an attempt to achieve a number of desirable results. However, such coating formulations often cause images to be generated which are not substantially light-fast and/or substantially smear-fast. That is, the images produced on the coated print media may still exhibit pick-up tire markings and/or pressure markings and may appear faded, blurred, and/or distorted over time.

BRIEF SUMMARY OF THE INVENTION

The present invention provides a print media including a substrate and at least one ink-receiving layer. The ink-receiving layer comprises at least one anionic fluorosurfactant and may be positioned over or above the substrate.

The present invention further provides a coating formulation for use in preparing an ink-receiving layer, the coating formulation comprising at least one anionic fluorosurfactant.

Additionally, the present invention provides a method for producing a print media comprising providing a substrate and forming at least one ink-receiving layer over and above the substrate, the ink-receiving layer comprising at least one anionic fluorosurfactant.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1A:
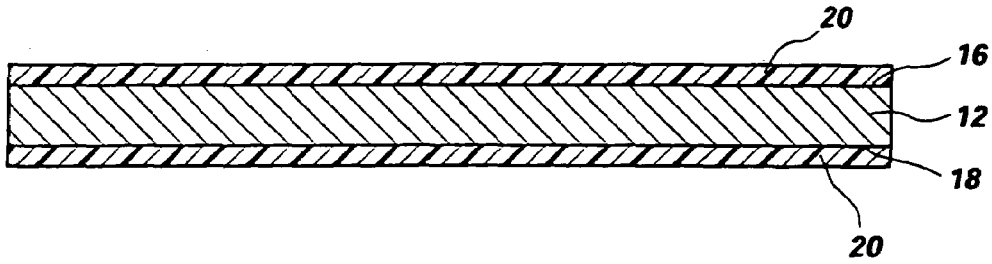
FIGS. 1A and 1B schematically illustrate a partial cross-sectional, sequential view of the process steps that may be employed to produce a print media in accordance with one embodiment of the present invention.

The present invention is directed to media for receiving substantially smear-fast and substantially light-fast printed images thereon. More specifically, the present invention is directed to print media having a substrate and at least one ink-receiving layer over the substrate, the ink-receiving layer comprising at least one anionic fluorosurfactant. The particular embodiments described herein are intended in all respects to be illustrative rather than restrictive. Other and further embodiments will become apparent to those of ordinary skill in the art to which the present invention pertains without departing from its scope.

The print media disclosed herein shall not be restricted to any particular component types, sizes, material-selections, arrangements of print media material/structures, chemical compositions, layering sequences, numbers of layers, layer orientations, thickness values, porosity parameters, material quantities, and other related factors unless otherwise expressly stated herein. For instance, it shall be understood and appreciated by those of ordinary skill in the art that one or more ink-receiving layers, each layer comprising at least one anionic fluorosurfactant, may be employed in connection with the print media of the present invention. In this regard, the print media disclosed herein shall not be restricted to any number of ink-receiving layers provided that at least one ink-receiving layer is utilized. Likewise, the location of the ink-receiving layer(s) of interest on or within the print media (s) may be varied as desired and employed in combination with one or more other material layers located above or below the claimed layer(s) of concern. It should therefore be emphasized that the print media under consideration shall cover the ink-receiving layer (or layers) of interest (namely, those that comprise at least one anionic fluorosurfactant) regardless of where such layer(s) are located, provided that they are able to receive on or within at least a portion of the ink compositions being delivered by the chosen printing system. Accordingly, the claimed subject matter shall be construed in its broadest sense to cover a print media (and method for producing the same) which employs at least one ink-receiving layer having at least one anionic fluorosurfactant therein so that this layer may receive at least a portion of the ink materials being delivered.

The print media and methods disclosed herein may be applicable to a wide variety of printing systems with particular reference to those that employ thermal inkjet technology. Likewise, a number of different ink materials may be used in connection with the print media discussed herein without limitation. As used herein, the term "ink materials" refers to compositions incorporating dyes, pigments, liquid or solid toners, powders, waxes, dispersions, and other colorants without restriction. Furthermore, such materials (e.g., colorants) shall encompass both chromatic (e.g., colored) and achromatic (e.g., black/white) ink materials. In this regard, the claimed print media shall not be considered "ink-specific" or "printing method-specific" in any fashion.

It will also be understood and appreciated by those of ordinary skill in the art that the present invention shall not be limited to any particular construction techniques (including any given material deposition procedures, layering arrangements, fabrication processes, and the like) unless otherwise indicated. For instance, the terms "forming", "applying", "positioning", "operatively attaching", "providing", and grammatical variants thereof as used throughout this disclosure and as claimed shall broadly encompass any appropriate manufacturing procedures including, without limitation, roll-coating, spray-coating; immersion-coating, cast-coating, slot-die coating, curtain coating, rod-coating, blade-coating, roller application, manual or automatic dipping, brush-coating, and other related production methods. In this regard, the invention shall not be considered "production method-specific" unless otherwise expressly stated herein, with the recitation of any particular fabrication techniques, layer deposition methods, number of layers applied in a given step, layer orientations, layer thicknesses, and the like being set forth for exemplary purposes only.

Likewise, it shall be understood that the terms "operative attachment", "in operative attachment", "operatively attached", "operatively positioned", "positioned on", "positioned above", "positioned over and above", "formed over and above", "formed under", "supported by", and the like as used herein shall be broadly construed to encompass a variety of divergent layering arrangements and assembly techniques. These arrangements and techniques include, by way of example only, the direct attachment of one material layer to another material layer with no intervening material layers therebetween, and the attachment of one material layer to another material layer with one or more material layers therebetween provided that the one layer being "supported by", "attached to", or "positioned over and above" the other layer is somehow "supported by" the other layer (not withstanding the presence of one or more additional material layers therebetween). Use of the phrase "direct attachment", "directly attached on", "directly attached to", "directly positioned on", "directly located on", "directly affixed to", and the like shall signify a situation wherein a given material layer is secured to another material layer without any intervening material layers therebetween.

Any statement used herein which indicates that one layer of material is "above", "over", "positioned over and above", or "on top of" another layer shall involve a situation wherein the particular layer that is "above", "over", "over and above", or "on top of" the other layer in question shall be the outermost of the two layers relative to the external environment. The opposite situation will be applicable regarding use of the terms "below", "under", "beneath", "on the bottom of", and the like. The characterizations recited above (with particular reference to "over and above") shall be effective regardless of orientation of the print media under consideration and, for example, shall encompass a situation where the ink-receiving layer of interest may be placed on either side of the substrate in question. Again, in the current invention, the claimed ink-receiving layer or layers may be located at any position on or within the print media provided that at least some of the ink materials being delivered by the chosen printing system are able to come in contact with such layer or layers, followed by the receipt of ink materials therein and/or thereon. Thus, while some or all of the drawing figures associated with this invention (and the embodiments discussed below) shall illustrate the claimed ink-receiving layer(s) on top of the substrate as the uppermost/outer-most structures which are exposed to the external environment with no other layers thereon, the claimed invention shall not be restricted to this design. In this regard, one or more other layers of material may be placed over or under the ink-receiving layers of interest in accordance with the explanation provided above.

Additionally, the terms "top", "uppermost", and "outermost" as applied to a given layer in the claimed structure shall again be construed to involve that layer which is at the top of the print media in question with no other layers thereon that are exposed to the external environment. When such layer faces the ink delivery components of the printer unit, it is typically the first component of the media to receive incoming ink materials with no other layers thereon. Likewise, any indication herein regarding a given layer being located "over and above" (or some other equivalent phrase) the substrate under consideration shall include a situation where the layer of concern is positioned over (e.g., on top of) the substrate either directly with no intervening layers being present or with one or more intervening layers therebetween. That is, the foregoing phrase (e.g., "over and above" and equivalents thereto) as it applies to a given layer shall be construed to include a situation where such layer is somehow above the substrate (e.g., outermost as previously defined relative to the substrate) whether or not any intervening layers are located between the substrate and the layer of concern.

Furthermore, any indication that the ink-receiving layer(s) (or other layers set forth herein) are somehow "supported by" the substrate under consideration (whether coated or uncoated as discussed hereinbelow) shall signify a situation where the layer(s) in question reside on the substrate and are directly attached thereto as previously defined or indirectly attached thereto with one or more layers therebetween. In such a situation, the layer(s) of concern rely on the substrate for structural support whether or not there are any intervening layers therebetween.

While the print media disclosed herein will be discussed with primary reference to thermal inkjet technology, it shall be understood that they may be employed in connection with different ink delivery systems and methods including, but not limited to, piezoelectric drop devices of the variety disclosed in U.S. Pat. No. 4,329,698 and dot matrix units of the type described in U.S. Pat. No. 4,749,291, as well as comparable and diverse systems designed to deliver ink using one or more ink delivery components/assemblies. In this regard, the claimed print media and methods shall not be considered "print method-specific". U.S. Pat. Nos. 4,329,698 and 4,749,291 are both incorporated herein by reference in their entireties.

Exemplary printer units which are suitable for use with the print media of the present invention include, by way of example only, DESKJET® printers (e.g., DESKJET®400C, 500C, 540C, 660C, 693C, 820C, 850C, 870C, 895CSE, 970CSE, 990CXI, 1200C, and 1600C), DESIGNJET® printers (e.g., DESIGNJET® 5000 series), and PHOTOSMART® printers(e.g., PHOTOSMART® P100 and P130), each of which is manufactured and sold by the Hewlett-Packard Company of Palo Alto, Calif. (USA).

Furthermore, the claimed invention (namely, the novel print media and production methods associated therewith) are not "ink-specific" and may be used in connection with a variety of inks, dyes, pigments, liquid and solid toner compositions, sublimation dyes, colorants, stains, waxes, and the like without restriction. For instance, representative ink compositions that can be employed in connection with the print media materials of the invention include, but are not limited to, those discussed in U.S. Pat. Nos. 4,963,189 and 5,185,034 (both incorporated herein by reference in their entireties) which represent only a small fraction of the ink compositions and colorant formulations that can be used with the claimed print media.

Figure 1B:
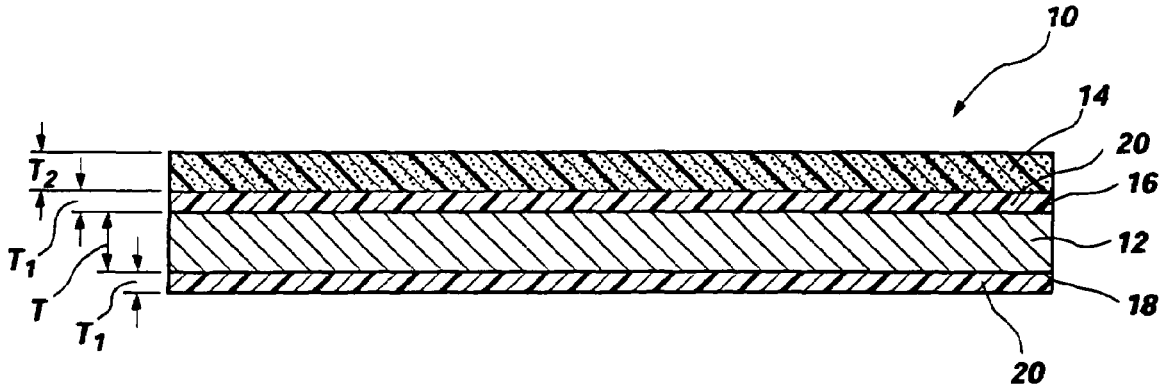

Referring now to the drawings in general, and initially to FIG. 1B in particular, a completed print media (also referred to herein as a "print media sheet", "ink-receiving sheet", "ink-receiving substrate", "ink-receiving member", and the like) in accordance with one embodiment of the present invention is illustrated and designated generally as reference numeral 10. Print media 10 includes a substrate 12 and an ink-receiving layer 14. The substrate 12 may be fabricated in the form of a flexible sheet comprising an upper surface 16 (also characterized herein as a "top surface") and a lower surface 18 (also characterized herein as a "bottom surface"), with both surfaces 16, 18 being substantially planar and having a uniform surface texture in the representative embodiment of FIG. 1B. Alternatively, the substrate 12 may be configured in roll, web, strip, film, or sheet form with transparent, semi-transparent, or opaque characteristics as desired. The other layers and materials associated with the print media 10 reside on this structure and are supported thereby.

In one embodiment of the print media 10, the substrate 12 may have an exemplary and non-limiting uniform thickness "T" along its entire length of between about 0.025 and about 0.38 mm (between about 1 and about 15 mils). It is currently preferred that the substrate 12 have a thickness of between about 0.15 and about 0.25 mm (between about 6 and 10 mils). Substrate 12 may comprise, without limitation, cellulosic (e.g., cellulose-containing) paper, photopaper, paperboard, wood, cloth, non-woven fabric, felt, synthetic (e.g., non-cellulosic) paper, ceramic compositions (optimally unglazed), glass or glass-containing products, vinyl, metals (e.g., in foil form made from, for instance, aluminum (Al), silver (Ag), tin (Sn), copper (Cu), mixtures thereof), as well as composites and/or mixtures of such materials. Likewise, various organic polymer compositions may be employed to form the substrate 12 including, without limitation, those fabricated from polyethylene, polystyrene, polyethylene terephthalate, polycarbonate resins, Teflon® (polytetrafluoroethylene), polyimide, polypropylene, cellulose acetate, poly(vinyl chloride), and mixtures thereof.

While the present invention shall not be restricted to any particular substrate 12, commercially-available photobase paper, in sheet form, is a currently preferred. An exemplary photobase paper which may be used in the print media 10 of the present invention is HP Premium Photopaper (Glossy) sold by the Hewlett-Packard Company of Palo Alto, Calif. (USA).

The ink-receiving layer 14 may be positioned over and above and/or be supported by the substrate 12 and comprises at least one anionic fluorosurfactant. The primary functions of the anionic fluorosurfactant are to adjust the surface energy of the print media 10 and to facilitate coatability during the manufacturing process. Furthermore, the range of surface energy provided from the anionic fluorosurfactant minimizes or prevents overspread of the ink dot size and, accordingly, minimizes pick-up tire markings and pressure markings. An exemplary anionic fluorosurfactant which may be used in the ink-receiving layer 14 of the present invention is Zonyl® FSA available from DuPont of Wilmington, Del. (USA). Zonyl® FSA has the structure:

$$RfCH_2CH_2SCH_2CH_2CO_2Li$$

wherein Rf is $F(CF_2CF_2)_x$, and wherein x is between about 1 and about 9.

The ink-receiving layer 14 may also comprise one or more organic or inorganic binder compositions (also characterized as simply "binders"). The term "binder" as used herein refers generally to compositions which have the ability to chemically, physically, electrostatically, or otherwise retain one or more materials together in a given formulation or structure in order to provide mechanical strength, cohesiveness, and the like.

A first exemplary binder that may be used in conjunction with the at least one anionic fluorosurfactant in the ink-receiving layer 14 of the present invention is gelatin. Gelatin basically consists of a product which is derived from hydrolysis of animal connective tissues. Gelatin is particularly useful for the production of ink-receiving layers employed in print media of the type disclosed herein as it is characterized by a high fluid absorption capacity which is especially desirable when ink materials are being delivered to a chosen print media. A high absorption capacity in a print media may permit rapid drying times, the ability to retain substantial amounts of ink in order to efficiently generate large-scale multi-color images, the avoidance of color bleed (namely, the undesired blending of multi-colored inks into each other during the printing process), as well as a high level of stability when the image is exposed to light and moisture. Additional benefits provided by the use of gelatin in the ink-receiving layer 14 may include, but are not limited to, improved image permanence, better humid-fastness, and good light-fastness. While the claimed invention shall not be restricted to any particular types, grades, or varieties of gelatin, a representative photographic grade gelatin material that is appropriate for use in the ink-receiving layer 14 (and any additional layers if desired, as more fully described below) is commercially available from DGF Stoess AG of Eberbach, Germany. This particular gelatin tends to promote an improved interaction between the ink-receiving layer 14 and the colorants being delivered thereto as well as provides favorable viscosity and bloom levels.

A second exemplary binder composition that may be used in conjunction with the at least one anionic fluorosurfactant in the ink-receiving layer 14 of the present invention is polyvinyl alcohol (PVOH). The basic structural formula for PVOH is as follows:

$$(—CH_2CHOH—)_x$$

wherein x is between about 1 and about 10000. Polyvinyl alcohol is commercially available from numerous sources including, but not limited to, Nippon Gohsei of Osaka, Japan under the product designation GOHSENOL NH-26, as well as Air Products and Chemicals, Inc. of Allentown, Pa. (USA) under the product designation Airvol® 523.

Exemplary and non-limiting derivatives of PVOH which shall be encompassed within the term "polyvinyl alcohol" as used herein include but are not limited to unsubstituted PVOH (as illustrated and discussed above), carboxylated PVOH, sulfonated PVOH, acetoacetylated PVOH, and mixtures thereof. Acetoacetylated PVOH has the following basic structural formula:

$$(—CH_2CHOH—)_x(—CH_2CHOCOCH_2COCH_3—)_y$$

wherein x is between about 1 and about 10000 and y is between about 1 and about 100. Acetoacetylated PVOH is commercially available from numerous sources including, for example, Nippon Gohsei of Osaka, Japan, under the product designation GOHSEFIMER Z 200. With respect to the use of PVOH as a binder composition, in a preferred embodiment, "straight" (e.g., unsubstituted) PVOH binders can be used.

The term "polyvinyl alcohol" as used herein shall encompass polyvinyl alcohols which are "fully hydrolyzed" or "partially hydrolyzed". During the production process associated with PVOH, varying degrees of hydrolysis can occur whereby, in certain situations, residual acetate groups ($—OCOCH_3$) are left within the PVOH backbone (depending on a wide variety of production and reaction parameters). For example, a PVOH molecule is traditionally considered to be "fully hydrolyzed" if less than about 1.5 mole percent acetate groups are left on the molecule.

In addition, the term "polyvinyl alcohol" shall also be defined and interpreted herein to encompass structures wherein the PVOH component thereof is considered to be "partially hydrolyzed". Partially hydrolyzed PVOH is typically defined to include PVOH molecules wherein about 1.5 to as much as about 20 mole percent or more acetate groups are left on the molecule. Again, the extent of hydrolysis will depend on a wide variety of production parameters. Polyvinyl alcohols having a hydrolysis level of between about 88% and about 99% are currently preferred. An exemplary 88% hydrolyzed PVOH is available from Clariant Corporation of Charlotte, N.C. (USA) under the product designation PVOH 2688.

Copolymers of PVOH may also be used as binder compositions in conjunction with the at least one anionic fluorosurfactant in the ink-receiving layer 14 of the present invention. The term "copolymer" as used herein shall be construed in a traditional fashion to encompass a polymer composition which is the product of two or more different compounds or groups which are used to form the polymeric structure/backbone. An exemplary PVOH copolymer that may be used in the ink-receiving layer 14 of the present invention is a modified PVOH available from Nippon Gohsei of Osaka, Japan, under the product designation PVOH-WO-320. PVOH-WO-320 is a copolymer of polyvinyl alcohol and polyethylene oxide. Another exemplary PVOH copolymer that may be used in the ink-receiving layer 14 of the present invention is a proprietary polymer of styrene-acrylate copolymer containing secondary amines available from PPG Industries, Inc. of Pittsburgh, Pa. (USA). This proprietary polymer is considered a cationic copolymer and, when used, may also function as a dye fixer (cationic mordant) to minimize dye diffusion.

Use of PVOH as a binder can offer a number of benefits in the ink-receiving layer 14 including, but not limited to, a high degree of binding strength, color accuracy, and bleed control, as well as improved color gamut.

Representative and non-limiting examples of additional binders which may be employed of the ink-receiving layer 14 (and/or in other layers in the print media 10, as more fully described below) include, without limitation, starch, SBR latex, alginates, carboxycellulose materials (for example, methyl-hydroxypropyl cellulose, ethylhydroxypropyl cellulose, and the like), polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), poly(vinyl acetate-ethylene) copolymer, poly(vinyl pyrrolidone-vinyl acetate) copolymer, and mixtures thereof.

Representative polyurethanes that are suitable for use as additional binder compositions alone or combined with the other binder compositions disclosed herein include, without limitation, the sub-class of compounds including water-soluble or water-dispersible polyurethane polymers, water-soluble or water-dispersible modified polyurethane resin dispersions, and mixtures thereof. Of particular interest is the employment of at least one modified polyurethane resin dispersion. The term "modified polyurethane resin dispersion" shall be generally defined herein to encompass polyurethane polymers having hydrophobic groups associated therewith, wherein such materials are water-dispersible. While many different modified polyurethane resin dispersions are commercially available from numerous sources (and are typically proprietary in nature), an exemplary modified polyurethane resin dispersion that may be used as an additional binder composition in conjunction with the at least one anionic fluorosurfactant in the ink-receiving layer 14 of the present invention is a product sold by Dainippon Ink and Chemicals/Dainippon International (USA), Inc. of Fort Lee, N.J. (USA) under the product designation PATELACOL IJ-30. Further, general information concerning this type of material (with particular reference to polyurethane dispersions/emulsions) is provided in Japanese Patent Publication No. 10-181189 which is incorporated herein by reference in its entirety. However, other polyurethane-based materials shall also be appropriate for use as additional binders within the ink-receiving layer 14 (or other layers, as more fully described below), with the above-listed composition being provided for example purposes only.

Regarding the employment of polyamide resins as additional binder compositions in conjunction with the at least one anionic fluorosurfactant in the ink-receiving layer 14 of the present invention, the following chemicals may be encompassed within this class of compounds without limitation: acrylic modified polyamides, acrylic polyamide copolymers, methacrylic modified polyamides, cationic polyamides, polyquaternary ammonium polyamides, poly(styrene-acrylic) copolymers, epichlorohydrin-containing polyamides, and mixtures thereof. One composition of particular interest within this group is an epichlorohydrin-containing polyamide. The term "epichlorohydrin-containing polyamide" shall be generally defined to involve an epichlorohydrin group-containing polyamide formulation, with this composition having the following basic structural/chemical formula:

$$(C_6H_{10}O_4.C_4H_{13}N_3.C_3H_5ClO)_x$$

wherein x is between about 1 and about 1000. Epichlorohydrin-containing polyamides are commercially available from, for example, Georgia Pacific Resins, Inc. of Crosett, Ark. (USA) under the product designation AMRES 8855.

In an exemplary and non-limiting embodiment, the ink-receiving layer 14 may contain between about 0.1 and about 1 part anionic fluorosurfactant and between about 99.9 and about 99 parts binder.

The ink-receiving layer 14 may further comprise one or more additional components without limitation. One such additional component may be at least one pigment composition. The terms "pigment" or "pigment composition" as used herein mean a material which is used to impart color, opacity, and/or structural support (e.g., in a "filler" capacity) to a given formulation. The ink-receiving layer 14 shall not be restricted to any given pigment compositions (organic or inorganic in nature), pigment quantities, or number of pigments in combination. For example, boehmite, pseudo-boehmite, or a mixture thereof can be used as an exemplary pigment composition in the ink-receiving layer 14. The terms "boehmite" and "pseudo-boehmite" shall be defined in a conventional fashion as would normally be understood and appreciated by those of ordinary skill in the art. For example, boehmite traditionally involves a crystalline compound having the empirical formula AlO(OH) (including all physical forms in which boehmite exists or may otherwise be produced). In addition, "pseudo-boehmite" (also known as "gelatinous boehmite") traditionally encompasses a type of boehmite having a higher water content than "regular" crystalline boehmite of the variety mentioned above.

The term "slip agent" as used herein refers to an agent that aids in reducing the friction levels of the completed ink-receiving layer 14 in order to make it smoother and more readily transferable through the printer unit(s) of interest. Exemplary slip agents include, by way of example only, products available from Elementis Specialties of Heightstown, N.J. (USA) under the product designation Slip-Ayd® (e.g., SL 1618) and polytetrafluoroethylene beads which are commercially available from, for instance, Shamrock Technologies, Inc. of Newark, N.J. (USA) under the product designation Fluoro AQ-50.

The term "pH modifier" as used herein refers to an agent which aids in achieving a desired pH level during formulation of the ink-receiving layer 14 (with a currently preferred pH level being between about three and about six). Exemplary pH modifiers include, without limitation, hydrochloric acid, sulfuric acid, citric acid, and mixtures thereof.

The term "gelatin hardener" as used herein refers to a composition which aids in hardening and otherwise assists in the overall solidification of any gelatin materials used in the formulation of the ink-receiving layer 14. Exemplary gelatin hardener compositions include, by way of example only, pyridinium-carbamoyl, metal oxides, aldehydes, amides, and vinyl sulfone.

The term "ink-fixative" as used herein refers to an agent which chemically, physically, or electrostatically binds with or otherwise fixes the ink materials of interest to, within, or on the ink-receiving layer 14. Exemplary ink fixatives include, without limitation, quarternary amine emulsion polymers, an example of which includes a proprietary composition that is commercially available from the Rohm and Haas Company of Philadelphia, Pa. (USA) under the product designation Primal® PR-26.

Various other additional ingredients may be incorporated within the ink-receiving layer 14 in addition to or instead of those recited above without limitation including biocides (for example, chlormetakresol), UV/light protectants and/or absorbents, fade-control agents, fillers, preservatives (e.g., antioxidants), buffers, wetting agents, plasticizers (humectants) and the like.

In an exemplary and non-limiting embodiment, the ink-receiving layer 14 may have a uniform thickness "$T_2$" (FIG. 1B) along its entire length of between about 1 μm and about 50 μm (preferably between about 15 μm and about 25 μm.

If desired, substrate 12 may be coated on at least one of the upper and lower surfaces 16, 18 thereof with a selected coating material or formulation that is substantially non-porous, non-absorbent, and ink-permeable. In the representative embodiment illustrated in FIG. 1B, a coating layer 20 is provided on the upper and lower surfaces 16, 18 of the substrate 12. The coating layer 20 may have a uniform thickness "T1" of between about 1 μm and about 40 μm. It is currently preferred that the coating layer 20 have a uniform thickness T1 between about 10 μm and about 30 μm. The coating layer 20 may be produced from a number of compositions without limitation, with such compositions (and the use of a coating layer 20 in general) being selected in accordance with numerous factors including the type of ink being delivered, the printing system in which the print media 10 will be used, and the like. If a non-porous, non-ink-absorbent coating layer 20 is desired, a representative material suitable for this purpose may include polyethylene. Other compositions which may be employed to achieve a non-porous, non-ink-absorbent coating layer 20 include various organic polymers such as polystyrene, polyethylene terephthalate, polycarbonate, resins, polytetrafluoroethylene (e.g., Teflon®), polyimide, polypropylene, cellulose acetate, poly(vinyl chloride), and mixtures thereof. In a preferred embodiment, at least the upper surface 16 of the substrate 12, and preferably both the upper and lower surfaces 16, 18, are coated with the selected coating material.

In another embodiment, the coating layer 20 may include a wide variety of other ingredients in order to form a more absorbent layer of material. These various ingredients include, but are not limited to, one or more pigments, binders, fillers, and other "supplemental ingredients" such as biocides, hardeners, UV/light stabilizes, buffers, slip agents, pH control compounds, preservatives (e.g., antioxidants), lactic acid, and the like. Of primary concern in connection with such a coating layer 20 is the use of at least one or more pigment compositions in combination with at least one or more binders. Exemplary pigments which may be employed in connection with the coating layer 20 include, without limitation, boehmite, pseudo-boehmite, silica (in precipitated, colloidal, gel, sol, and/or fumed form), cationic-modified silica (e.g., alumina-treated silica), cationic polymeric binder-treated silica, magnesium oxide, polyethylene beads, polystyrene beads, magnesium carbonate, calcium carbonate, barium sulfate, clay, titanium dioxide, gypsum, and mixtures thereof. By way of example and not limitation, between about 20% and about 90% by weight, preferably between about 40% and about 70% by weight, pigment may be employed in the coating composition used to form the coating layer 20.

Regarding the use of one or more binder materials in the coating layer 20, such compositions may include, without limitation, polyvinyl alcohol and derivatives thereof (e.g., carboxylated polyvinyl alcohol, sulfonated polyvinyl alcohol, acetoacetylated PVOH, and mixtures thereof), starch, SBR latex, gelatin, alginates, carboxycellulose materials, polyacrylic acid and derivates thereof, polyvinyl pyrrolidone, casein, polyethylene glycol, polyurethanes (for example, a modified polyurethane resin dispersion), polyamide resins (for instance, an epichlorohydrin-contaiing polyamide), poly (vinyl pyrrolidone-vinyl acetate) copolymers, poly(vinyl acetate-ethylene) copolymers, poly(vinyl alcohol-ethylene oxide) copolymers, and mixtures thereof. By way of example and not limitation, between about 10 parts and about 80 parts by weight, preferably between about 10% and about 40% by weight, binder materials may be used in the coating composition used to form the coating layer 20.

Should any of the other components recited above (namely, the optional "supplemental ingredients") be employed within this particular embodiment of the coating layer 20, the amount thereof may be varied as desired. In this regard, the present invention shall not be limited to any particular numerical values in connection with the coating layer 20, with the quantity of binders and/or pigments in the layer 20 (if used) being reduced proportionately relative to the amount of any supplemental ingredients that may be added.

If a coated substrate 12 is employed, the coating layer 20 shall be construed and defined as part of the substrate 12, with the representative thickness value "T" associated with the substrate 12 being suitably adjusted in this regard. Such a characterization is appropriate since coated paper materials including those discussed herein are traditionally available in pre-manufactured form from various paper suppliers and producers. If a representative photopaper substrate 12 covered on both surfaces 16, 18 with a gelatin coating layer 20 that may be used is commercially available in completed form from Hewlett-Packard Company of Palo Alto, Calif. (USA) under the product designation HP Premium Photopaper (Glossy).

If a coating layer 20 is employed on the substrate 12, the ink-receiving layer 14 may be positioned on the coating layer 20 as shown in FIG. 1B. If a coating layer 20 is not employed on the substrate 12 (embodiment not shown), the ink-receiving layer 14 could simply be positioned on the upper surface 14 of the substrate 12. In either instance, the ink-receiving layer 14 is designed and configured for use as the "top", "uppermost", or "outermost" layer of material associated with the print media 10. Likewise, the ink-receiving layer 14 may be configured for direct attachment to the coating layer 20 or the upper surface 14 of the substrate 12. However, it shall be understood that the print media 10 may contain at least one additional layer of material (also known as an "additional material layer") located above or below the ink-receiving layer 14.

Figure 2A:
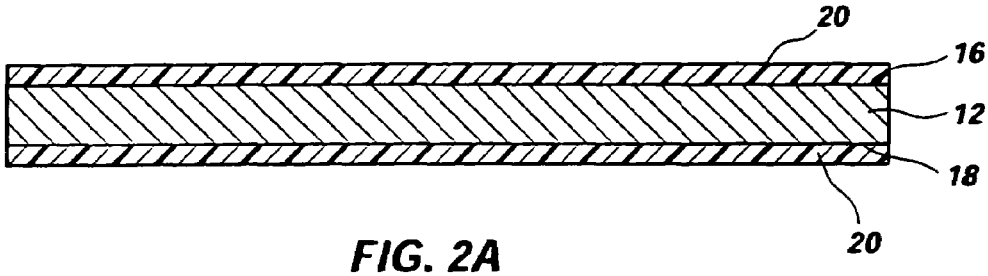
FIGS. 2A-2C schematically illustrate a partial cross-sectional, sequential view of the process steps that may be employed to produce a print media in accordance with another embodiment of the present invention wherein the completed print media includes an additional material layer positioned over an ink-receiving layer.
Figure 2B:
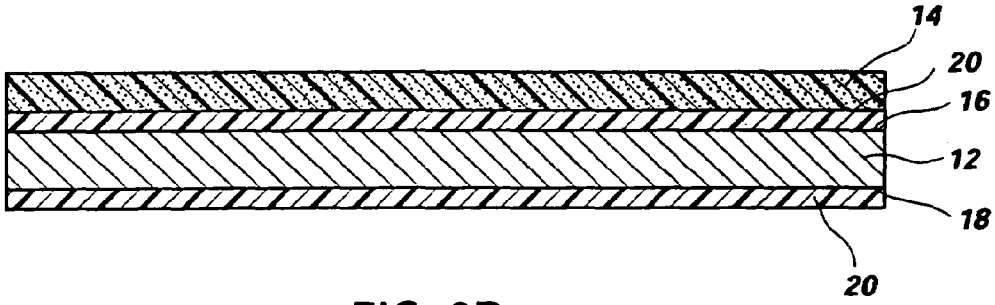
Figure 2C:
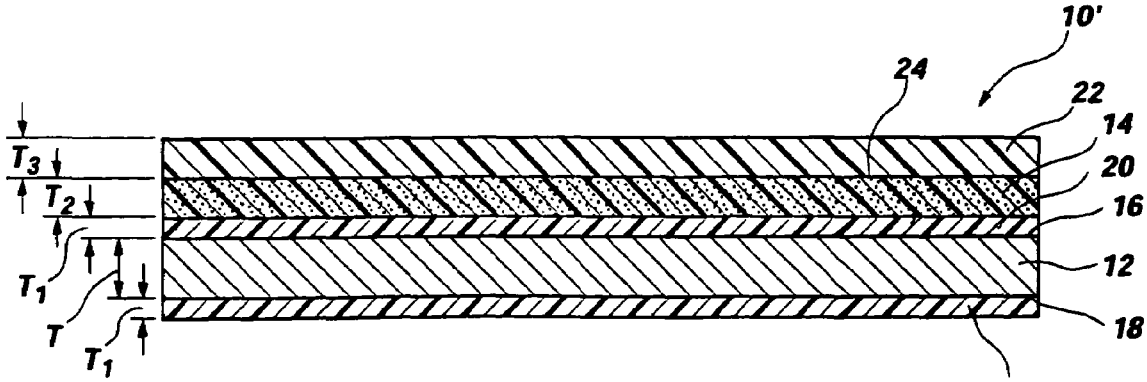
Figure 3A:
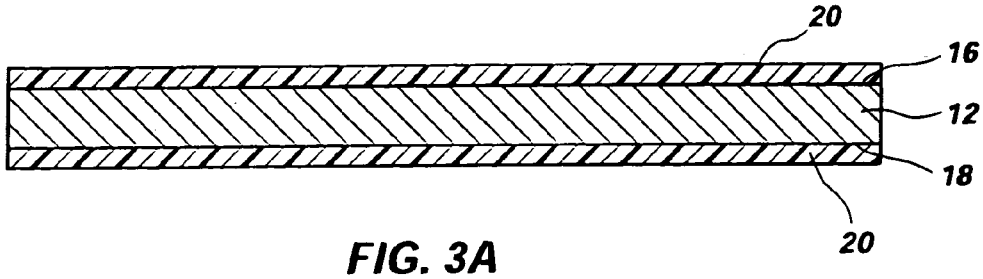
FIGS. 3A-3C schematically illustrate a partial cross-sectional, sequential view of the process steps that may be employed to produce a print media in accordance with yet another embodiment of the present invention wherein the completed print media includes an additional material layer positioned between a coating layer formed over the substrate and an ink-receiving layer.
Figure 3B:
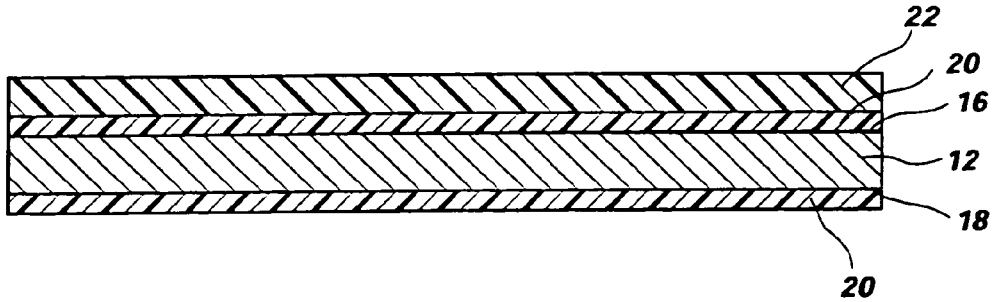
Figure 3C:
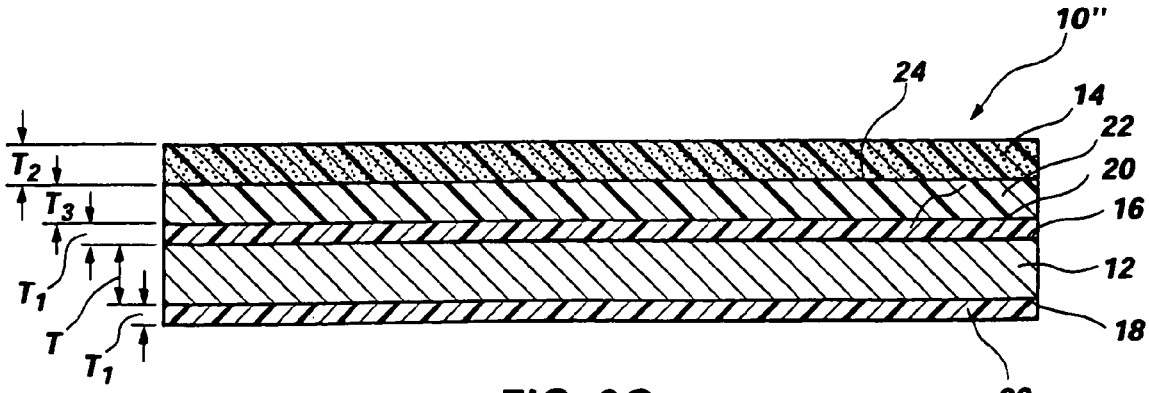

Examples of print media 10', 10" which employ an additional layer of material are schematically illustrated in FIGS. 2C and 3C, respectively. This additional material layer (likewise characterized herein as a "medial layer", or "intermediate layer" in the embodiment of FIGS. 2C and 3C) is shown at reference numeral 22. In the embodiment of FIG. 2C, the additional material layer 22 is positioned over and above (e.g., operatively attached to) the ink-receiving layer 14 and is therefore "supported by" the ink-receiving layer 14. The ink-receiving layer 14 is positioned over and above the top or upper surface 24 of the additional material layer 22 and is supported thereby. In the embodiment of FIG. 3C, the additional material layer 22 is positioned over and above the upper surface 14 of the substrate 12 (with or without the coating layer 20) and is therefore "supported by" the substrate 12. In a preferred embodiment, the additional material layer 22 is "directly affixed" to the upper surface 14/coating layer 20 or ink-receiving layer 14 (i.e., without any intervening materials or layers therebetween). Likewise, in the embodiment of FIG. 3C, the ink-receiving layer 14 is positioned over and above (e.g., "supported by") the top or upper surface 24 of the additional material layer 22 with "direct affixation" of such components being currently preferred. A thickness value "$T_3$" associated with the additional material layer 22 may be from about 1 μm to about 50 μm, preferably between about 10 μm and about 40 μm.

The additional material layer 22 may be made from a number of different ingredients including, but not limited to, pigment compositions, binders, fillers, defoamer compositions, lubricants, UV/light stabilizers, biocides, agents, preservatives (e.g., antioxidants), general stabilizers, ink fixatives, and hardeners, used alone or in combination without restriction. All of the ingredients recited above in connection with the ink-receiving layer 14 may also be employed within the additional material layer 22, alone or in various combinations, without limitation regarding the number, type, and quantity thereof. Thus, all of the data listed herein involving the ink-receiving layer 14 and the various compositions which can be used in the ink-receiving layer 14 is equally applicable to the additional material layer 22 and incorporated in the current discussion by reference. For example, the additional material layer 22 may contain at least one pigment composition (without any binders), at least one binder (without any pigment compositions), or a mixture of at least one pigment and at least one binder. Furthermore, one or more of the other additional/supplemental materials recited above in connection with the ink-receiving layer 14 can also be employed, with the additional material layer 22 not being limited in connection with any types, amounts, or quantities of ingredients, as previously stated. In one embodiment, the print media 10" may include an additional polymer-enriched material layer positioned between the substrate 12 (whether coated or uncoated) and the ink-receiving layer 14 that functions as a reservoir and provides capacity to absorb the ink materials.

The present invention further comprises a coating formulation (also characterized herein as a "coating composition") that is used to produce the ink-receiving layer 14 of the present invention. It is currently preferred that the coating formulation be in fluidic (e.g., "fluid-containing") form and contain at least one liquid carrier medium, if desired. Exemplary carrier media include, without limitation, water, organic solvents (e.g., n-methyl pyrrolidone, 2-propanol, or butanol), or mixtures thereof, with water as the sole carrier medium being currently preferred. The coating formulation may contain, in one embodiment, at least one anionic fluorosurfactant and any of the supplemental/additional ingredients recited above in connection with the ink-receiving layer 14. In this regard, the foregoing discussion of these supplemental ingredients is incorporated in the current discussion by reference.

Regarding the liquid carrier medium, it is currently preferred that from about 50 parts to about 100 parts (more preferably between about 80 parts and about 100 parts) be utilized, with the balance involving organic solvents such as n-methyl pyrrolidone, 2-propanol, butanol, or mixtures thereof without limitation. The coating formulation may typically have a solids content of at least about 20 parts or more, with a currently preferred solids content range being between about 20 parts and about 45 parts (more preferably between about 25 parts and about 40 parts).

The present invention further comprises a method for producing a print media 10 of the present invention. Initially, a substrate (with or without a coating layer 20) is provided (FIG. 1A). Subsequently, at least one ink-receiving layer 14 comprising at least one anionic fluorosurfactant and, optionally, one or more additional components (as previously discussed) is formed over and above the substrate 12 (and/or coating layer 20 associated therewith, if present) as shown in FIG. 1B. A number of different techniques may be employed to apply, form, or otherwise deliver the ink-receiving layer 14 in position over and above the substrate 12/coating layer 20. Formation of the ink-receiving layer 14 is typically accomplished by coating the substrate 12/coating layer 20 with the coating formulation discussed above. A number of different delivery/coating methods may be implemented for this purpose including, but not limited to, the use of a conventional slot-die processing system, Meyer bar apparatus, curtain coating system, rod coating device, brush delivery applicator, spraying unit, or other comparable techniques/devices including those that employ circulating and non-circulating coating technologies. An exemplary coating weight range associated with the ink-receiving layer 14 (irrespective of the coating method that is employed) is between about 5 g/m$^2$ and about 30 g/m$^2$ (more preferably between about 10 g/m$^2$ and about 20 g/m$^2$) with reference to the completed (e.g., dried) ink-receiving layer 14. However, the claimed invention and its various embodiments shall not be restricted to any particular layer application/formation methods (and coating weights) with a number of different alternatives being employable.

Once the above-listed coating composition is applied to the substrate 12 (or coating layer 20), it shall be characterized hereinafter as the ink-receiving layer 14. After this step, the substrate 12 having the ink-receiving layer 14 thereon is preferably dried. This may be accomplished by heating the substrate 12/ink-receiving layer 14 combination at a preferred and non-limiting temperature of between about 80° C. and about 120° C. (preferably between about 90° C. and about 110° C.) within a conventional oven-type heating apparatus of a variety normally used for fabricating sheet-type print media. The substrate 12/ink-receiving layer 14 combination will typically move through the heating apparatus at a representative "web speed" of between about 150 and about 800 feet/minute (preferably between about 250 and about 600 feet/minute). However, it shall also be understood that other drying methods may be implemented without limitation provided that the compositions associated with the ink-receiving layer 14 are effectively dried at this stage. The overall thickness of the print media 10 illustrated schematically in FIG. 1B, may readily be determined by simply adding up all of the aforementioned thickness values "T", "$T_1$", and "$T_2$" associated with the substrate 12, coating layer 20 (if used), and ink-receiving layer 14, respectively. The total thickness of the print media 10 can, of course, be appropriately varied depending on the number of additional layers that may be employed within the print media 10.

It will be understood and appreciated by those of ordinary skill in the art that if one or more additional material layers 22 are utilized, whether above or below the ink-receiving layer 14, such additional material layers 22 may be formed as previously discussed with regard to the ink-receiving layer 14 and that the method hereinabove set forth may be varied accordingly. An embodiment of the method, wherein an additional material layer 22 is formed over and above the ink-receiving layer 14 subsequent to the ink-receiving layer 14 being formed over and above the substrate 12 (including a coating layer 20 in this exemplary embodiment), is shown in FIGS. 2A-2C. An embodiment of the method, wherein an additional material layer 22 is formed over the upper surface 14 of the substrate 12 (including a coating layer 20 in this exemplary embodiment) prior to formation of the ink-receiving layer 14 over and above the upper surface 24 of the additional material layer 14, is shown in FIGS. 3A-3C.

It should be noted that each of the embodiments described herein and shown in each of the drawing figures are basically "one-sided" with the ink-receiving layer 14 and any layer(s) thereunder or thereover (with the exception of the coating layer 20) being located on only one side of the substrate 12. Nonetheless, other print media encompassed within this invention may involve placement of the foregoing layers on either or both sides of the substrate 12 (coated or uncoated), if desired, without limitation. Taking this information into account, the use of "on" the substrate, "over and above" the substrate, "operatively attached to" the substrate, "supported by" the substrate, "affixed to" the substrate, and the like when describing the layering arrangements discussed herein shall encompass both "one-sided" and "dual-sided" media sheets. This language will specifically be understood to involve situations in which the subject layers are placed on either or both sides of the substrate 12. However, if a substrate 12 is employed which includes a coating layer 20 thereon, the ink-receiving layer 14 and any layer(s) thereunder or thereover may be positioned on the side(s) of the substrate 12 that is coated with the coating layer 20, irrespective of the materials employed within the coating layer 20 and/or the ink-receiving layer 14.

The following examples describe the formation of a print media 10 employing an ink-receiving layer 14 in accordance with a particular embodiment of the present invention in comparison to print media employing prior art ink-receiving layers. The examples are merely illustrative and are not meant to limit the scope of the present invention in any way.

EXAMPLES

Example 1

Ink-Receiving Layer Comprising Nonionic Fluorosurfactant

A photobase paper manufactured and commercially available from the Felix Schoeller Company of Germany was obtained. A first layer comprising 8.4 g gelatin (available from, for example, DGF Stoess AG of Eberbach, Germany) and 7.02 g 88% hydrolyzed PVOH obtained from Clariant Corporation of Charlotte, N.C. (USA) under the product designation PVOH 2688, was applied to the upper surface of the coated photobase substrate. This polymer enriched layer functions as a reservoir and provides capacity to absorb the ink vehicle.

An ink-receiving layer was subsequently applied over and above the first layer, the ink-receiving layer comprising 0.5 g gelatin, 0.5 g proprietary styrene-acrylate copolyme, 1.25 g PVOH 2688, 0.25 g cellulose, and 0.0075 g Lodyne® S107B, a commercial nonionic fluorosurfactant obtained from Ciba Specialty Chemicals, Inc. of Tarrytown, N.Y. (USA).

Example 2

Ink-Receiving Layer Comprising Nonionic Fluorosurfactant

A coated photobase substrate having a polymer-enriched layer and first layer as described hereinabove was prepared as previously set forth in Example 1. Subsequently, an ink-receiving layer was applied over and above the first layer, the ink-receiving layer comprising 0.5 g gelatin, 0.5 g proprietary styrene-acrylate copolymer, 1.25 g PVOH2688, 0.25 g cellulose, and 0.0075 g Zonyl® FSN, a commercial nonionic fluorosurfactant obtained from Dupont of Wilmington, Del. (USA).

Example 3

Ink-Receiving Layer Comprising Anionic Fluorosurfactant

A coated photobase substrate having a polymer enriched layer and first layer as described hereinabove was prepared as previously set forth in Example 1. Subsequently, an ink-receiving layer was applied over and above the first layer, the ink-receiving layer comprising 0.5 g gelatin, 0.5 g proprietary styrene-acrylate copolyme, 1.25 g PVOH 2688, 0.25 g cellulose, and 0.0075 g Zonyl® FSA, a commercial anionic fluorosurfactant obtained from Dupont of Wilmington, Del. (USA).

Example 4

Comparative Performance Analysis

A substrate prepared according to each of Examples 1-3 above was subsequently dried in a conventional oven-type heating apparatus of a variety normally used for fabricating sheet-type print media at a temperature of approximately 100° C. Then, the dried substrates were run through a PHOTOSMART® P100 printer unit (available from the Hewlett-Packard Company of Palo Alto, Calif. (USA)) and images comprising cyan, yellow, magenta, black, light cyan, and light magenta were printed thereon.

As compared to the substrates comprising ink-receiving layers having a nonionic fluorosurfactant, the substrate prepared in accordance with Example 3 exhibited smaller dot sizes. Particularly, the light cyan dot size was approximately 4 micrometers smaller than the light cyan dot sizes of the other substrates. In addition, the rubber marking was improved with Example 3 listed in Table 1.

TABLE 1

Rubber Marking Comparisons

| Examples | Rubber Marking |
|---|---|
| #1 | bad |
| #2 | bad |
| #3 | good |

Light fastness performance was also improved with Example 3 and is listed in Table 2.

TABLE 2

Light fastness Comparison

| Examples | Light fastness (years to fail) |
|---|---|
| #1 | 8.6 |
| #2 | 11.2 |
| #3 | 15.3 |

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, limited only by the appended claims and their legal equivalents, rather than by the foregoing description. All additions, deletions and modifications to the invention, as disclosed herein, which fall within the meaning and scope of the claims, are to be embraced thereby.

What is claimed is:

1. A print media, comprising:

a substrate;

at least one ink-receiving layer positioned over the substrate, the ink-receiving layer comprising surfactant, said surfactant being present in the at least one ink-receiving layer at from about 0.1 to about 1 part, and said surfactant being only anionic fluorosurfactant without any other surfactant present; and at least one additional material layer positioned adjacent to the at least one ink-receiving layer.

2. The print media of claim 1, wherein the at least one ink-receiving layer further comprises at least one binder.

3. The print media of claim 1, further comprising at least one additional material layer positioned between the substrate and the at least one ink-receiving layer.

4. The print media of claim 3, wherein the at least one additional material layer comprises at least one binder.

5. The print media of claim 3, wherein the at least one additional material layer comprises at least one binder.

6. The print media of claim 1, wherein the at least one ink-receiving layer is directly affixed to the substrate.

7. The print media of claim 1, wherein the substrate further comprises a first side and a second side, and wherein at least one of the first side and the second side comprises a coating layer thereon comprised of polyethylene.

8. A print media, comprising:

a substrate;

at least one ink-receiving layer supported by the substrate, the ink-receiving layer comprising surfactant, said surfactant being present in the at least one ink-receiving layer at from about 0.1 to about 1 part, and said surfactant being only anionic fluorosurfactant without any other surfactant present; and at least one additional material layer positioned adjacent to the at least one ink-receiving layer.

9. The print media of claim 8, wherein the at least one ink-receiving layer further comprises at least one binder.

10. The print media of claim 8, further comprising at least one additional material layer positioned between the substrate and the at least one ink-receiving layer.

11. The print media of claim 8, further comprising at least one additional material layer positioned over and above the at least one ink-receiving layer.

12. A method for producing a print media, comprising:

providing a substrate;

forming at least one ink-receiving layer in a position over the substrate, the ink-receiving layer comprising surfactant, said surfactant being present in the at least one ink-receiving layer at from about 0.1 to about 1 part, and said surfactant being only anionic fluorosurfactant without any other surfactant present; and forming at least one additional material layer positioned adjacent to the at least one ink-receiving layer.

13. The method of claim 12, further comprising forming at least one additional material layer positioned between the substrate and the at least one ink-receiving layer.

14. The method of claim 12, further comprising forming at least one additional material layer in position over and above the at least one ink-receiving layer.

* * * * *